US011486583B2

(12) United States Patent
Zhang et al.

(10) Patent No.: US 11,486,583 B2
(45) Date of Patent: Nov. 1, 2022

(54) LIFTING MECHANISM WITH MOVABLE COMPONENT AND FOR RANGE HOOD, AND RANGE HOOD USING LIFTING MECHANISM

(71) Applicant: Ningbo Fotile Kitchen Ware Co., Ltd., Ningbo (CN)

(72) Inventors: Jing Zhang, Ningbo (CN); Feng Ye, Ningbo (CN); Zhixian Shen, Ningbo (CN); Zhongqun Mao, Ningbo (CN); Yongding Zhu, Ningbo (CN)

(73) Assignee: Ningbo Fotile Kitchen Ware Co., Ltd., Ningbo (CN)

( * ) Notice: Subject to any disclaimer, the term of this patent is extended or adjusted under 35 U.S.C. 154(b) by 766 days.

(21) Appl. No.: 16/473,545

(22) PCT Filed: Sep. 5, 2017

(86) PCT No.: PCT/CN2017/000559

§ 371 (c)(1),
(2) Date: Jun. 25, 2019

(87) PCT Pub. No.: WO2018/120259

PCT Pub. Date: Jul. 5, 2018

(65) Prior Publication Data

US 2019/0368748 A1 Dec. 5, 2019

(30) Foreign Application Priority Data

Dec. 29, 2016 (CN) ..... 201611244546.7

(51) Int. Cl.

| | |
|---|---|
| ***F24C 15/20*** | (2006.01) |
| ***F24F 7/06*** | (2006.01) |
| ***F24F 7/00*** | (2021.01) |
| ***B66F 7/28*** | (2006.01) |
| ***B66F 9/075*** | (2006.01) |

(52) U.S. Cl.

CPC ..... *F24C 15/2085* (2013.01); *B66F 7/28* (2013.01); *B66F 9/075* (2013.01); *F24C 15/2092* (2013.01); *F24F 7/06* (2013.01); *F24F 2007/001* (2013.01)

(58) Field of Classification Search

CPC ... F24F 7/06; F24F 2007/001; F24C 15/2092; F24C 15/2085

USPC ..... 126/299 F

See application file for complete search history.

(56) References Cited

FOREIGN PATENT DOCUMENTS

| | | | | |
|---|---|---|---|---|
| CN | 101285601 A | * | 10/2008 | ..... F24C 15/2085 |
| CN | 204880294 U | * | 12/2015 | |

* cited by examiner

*Primary Examiner* — Allen R. B. Schult
(74) *Attorney, Agent, or Firm* — Wang Law Firm, Inc.

(57) ABSTRACT

The present invention discloses a lifting mechanism for a moving component of a range hood and a range hood with the same, which comprises a mounting frame, a moving component, a motor, a transmission mechanism, two lifting rods, a connecting member and two guide rails. The transmission mechanism moves the connecting member up and down along the guide rails, so that the lifting rods and the moving component are allowed to move up and down. The power for the lifting motion is provided by the transmission mechanism, the guide rails on two sides ensure the stability of the lifting motion, and the lifting rods fixed on two sides of the connecting member further transfers the motion downward to the smoke guide plate, so that the lifting motion of the smoke guide plate is very stable.

15 Claims, 17 Drawing Sheets

LIFTING MECHANISM WITH MOVABLE COMPONENT AND FOR RANGE HOOD, AND RANGE HOOD USING LIFTING MECHANISM

RELATE APPLICATIONS

This application is a national phase entrance of and claims benefit to PCT Application for a lifting mechanism for a moving component of a range hood and a range hood with the same, PCT/CN2017/000559, filed on Sep. 5, 2017, which claims benefit to Chinese Patent Applications 201611244546.7, filed on Dec. 29, 2016. The specifications of both applications are incorporated here by this reference.

FIELD OF THE INVENTION

The present invention relates to a range hood, and in particular to a lifting mechanism for a moving component of a range hood and a range hood with the same.

DESCRIPTION OF THE PRIOR ART

At present, in order to improve the smoke suction effect of range hoods, various range hoods with moving smoke guide plates have been invented. During the operation of range hoods, the smoke guide plate is driven to do a lifting motion or a deflection motion by a driving mechanism, so that the angle of the air inlet and the air intake volume. For example, a Chinese Patent CN 205372692 U (Patent No. 201620042811.2) has disclosed a European-style range hood with an automatic smoke guide plate, which comprises a smoke guide plate and a fixed plate; a fixed plate is disposed on one side of the fixed plate; a moving guiding plate matched with the fixed guide rail is disposed in the fixed guide rail; a transmission rod resisted against the moving guide rail is arranged besides the fixed guide rail; a motor connected to the transmission rod is disposed on the other side of the fixed plate; a fixed support resisted against the smoke guide plate is disposed at a lower end of the moving guide rail; a connecting rod is provided on the transmission rod, and the connecting rod is arranged on the moving guide rail; and, the transmission rod and the connecting rod are driven by the motor, so the moving guide rail is allowed to move up and down on the fixed guide rail to control the upward and downward movement of the smoke guide plate. The driving mechanism for driving the smoke guide plate to move up and down in the range hood is simple in structure and reasonable in arrangement. However, since the smoke guide plate driving mechanism of the range hood does not consider the pollution of the smoke environment, after long-term use, each component of the driving mechanism is easily stained with oil dirt, so that the kinetic friction between components is increased, the smoke guide plate is difficult to smoothly move up and down, and the service life of the driving mechanism will also be reduced. In addition, due to the presence of smoke in the kitchen, similar problems will occur in other devices requiring slide rods, for example, drawer-type disinfection cabinets, steamers with telescopic panels, ovens and the like.

For another example, Chinese Patent Application CN 105423395 A (Application No. 201610029797.7) has disclosed a European-style range hood with an automatic smoke guide plate, which comprises a smoke guide plate and a fixed plate; a fixed plate is disposed on one side of the fixed plate; a moving guiding plate matched with the fixed guide rail is disposed in the fixed guide rail; a transmission rod resisted against the moving guide rail is arranged besides the fixed guide rail; a motor connected to the transmission rod is disposed on the other side of the fixed plate; a fixed support resisted against the smoke guide plate is disposed at a lower end of the moving guide rail; a connecting rod is provided on the transmission rod, and the connecting rod is arranged on the moving guide rail; and, the transmission rod and the connecting rod are driven by the motor, so the moving guide rail is allowed to move up and down on the fixed guide rail to control the upward and downward movement of the smoke guide plate. Since the lifting mechanism for the smoke guide plate of the range hood has only one moving guide rail, the operation of the smoke guide plate is not stable enough, and the accurate guidance cannot be realized during the movement of the smoke guide plate.

In addition, although oil filter screens of a double-layer oil filter screen structure have been disclosed in the prior art, the distance between two layers of oil filter screens cannot adjusted after the oil filter screens have been mounted. For example, Chinese Patent CN 201836954 U (Patent No. 201020541690.9) has disclosed an oil filter device for a range hood and a range hood, which is of a double-layer structure, and comprises a pore plate filter screen at the outer layer and a silk screen fixed on an inner side of the pore plate filter screen; a number of meshes are formed on the silk screen, a number of air inlet holes are formed on the pore plate filter screen, and the area of all the air inlet holes on the pore plate filter screen is 50% to 56% of the total area of the pore plate filter screen. The filter device can ensure the full contact of smoke with the oil filter device so as to separate smoke to the greatest extent, and can also ensure a certain air inlet area so that the loss of air volume and air pressure. The range hood using this filter device has a sufficient suction force. However, the distance between the pore plate filter screen and the silk screen in the filter device cannot be adjusted, that is, the air inlet area cannot adaptively adjusted depending upon the change in working condition of the range hood, so the degree of intelligence is relatively low.

SUMMARY OF THE INVENTION

A first technical problem to be solved by the present invention is to provide a lifting mechanism for a moving component of a range, which is simple in structure and realizes stable movement of the moving component.

A second technical problem to be solved by the present invention is to provide a range hood having a moving component capable of stably moving up and down.

To solve the first technical problem, the lifting mechanism for a moving component of a range, comprises a mounting frame and a moving component located below the mounting frame, a motor, a transmission mechanism connected to the motor, at least two lifting rods located at the sides of mounting frame, each lifting rod having a bottom, a connecting member connecting the at least two lifting rods to the transmission mechanism, and at least two guide rails located at the sides of mounting frame; the transmission mechanism is attached to the mounting frame and driven by the motor; the bottom of each lifting rod is connected to the moving component; the transmission mechanism moves the connecting member up and down along the guide rails, so that the lifting rods and the moving component are allowed to move up and down.

The mounting frame and the connecting member can be of various structures. Preferably, the mounting frame has a front plate, a left side plate and right side plate. The motor and the transmission mechanism are disposed on the front plate, and the guide rails are disposed on the left side plate and the right side plate. The connecting member is a U-shaped connecting plate with a front portion, a left portion, and a right portion located outside mounting frame. The left portion and the right portion of the connecting plate, each is attached to the top of a corresponding lifting rod; the left portion and the right portion of the connecting plate each can slide along the corresponding guide rail; and the front portion of the U-shaped connecting plate is connected to an output end of the transmission mechanism.

To prevent the transmission mechanism from generating noise and jitter during the operation process and enable the operating state of the transmission mechanism to always be in an optimal state, preferably, the transmission mechanism comprises a lead screw, a first nut, a second nut and a spring; the lead screw is disposed vertically and driven to rotate by the motor; the first nut and the second nut are successively disposed on the lead screw from the top down; the spring is sheathed on the lead screw and placed between the first nut and the second nut; the first nut is attached to the connecting member; and, the spring applies a vertical upward elastic force to the first nut, so that the first nut is prevented from colliding with the lead screw during its movement due to a fit clearance between the first nut and the lead screw.

To better limit the spring between the first nut and the second nut, a recessed first mounting step is disposed on a bottom surface of the first nut, a recessed second mounting step is disposed on a top surface of the second nut, and two ends of the spring are resisted against the first mounting step and the second mounting step, respectively.

To allow the transmission mechanism to be in the optimal operating state, the first nut is used for mounting a load; the spring applies a vertical upward elastic force F' to the first nut; the gravity of the load, the gravity of the first nut and a component force of the friction between the first nut and the lead screw in a vertical downward direction form a resultant force F; and the magnitude of the elastic force F' and the magnitude of the resultant force F satisfy the following condition: F'=F.

There can be various transmission mechanisms between an output shaft of the motor and the lead screw. Preferably, a screw rod is mounted on the output shaft of the motor, a transmission gear, which is disposed coaxially to the lead screw and can be rotated together, is mounted at an end of the lead screw, and the transmission gear is engaged with the screw rod.

Further, preferably, the transmission mechanism further comprises an upper mounting seat, a lower mounting seat and a lead screw shield disposed between the upper mounting seat and the lower mounting seat; a first bearing is disposed on the upper mounting seat, and an upper end of the lead screw is mounted on the first bearing; a second bearing is disposed on the lower mounting seat, and a lower end of the lead screw is mounted on the second bearing; strip-shaped holes disposed vertically are formed on the lead screw shield; and, both the first nut and the second nut partially pass through the strip-shaped holes and are exposed to the lead screw shield.

To enable the lifting motion of the lifting rods and the moving component more stable, the first nut and the second nut are respectively guided by the lead screw shield.

As another preferred solution of the transmission mechanism, the transmission mechanism comprises a gear and a rack, the motor drives the gear to rotate, the rack is engaged with the gear and does a lifting motion under the drive of the gear, and the rack is used for connecting the connecting member.

The moving component of the range hood can be of various types. Preferably, the moving component is a smoke guide plate or an oil filter screen.

To solve the second technical problem, the range hood with the lifting mechanism comprises an outer fan hood, a decorative hood and a smoke collecting hood, wherein the moving component of the lifting mechanism is disposed below the smoke collecting hood, the mounting frame of the lifting mechanism is the outer fan hood; a mounting space is formed between the outer fan hood and the decorative hood; the motor and the transmission mechanism are mounted on the front plate and located inside the mounting space; and, the lifting rods pass downward through the smoke collecting hood and are connected to the moving component.

To realize the floated sealing effect of a sealing gasket between the smoke collecting hood and a cover plate, a first through hole is formed on the smoke collecting hood, a cover plate is covered at a position on the smoke collecting hood corresponding to the first through hole, and a second through hole aligned with the first through hole is formed in the center of the cover plate, so that an annular chamber surrounding the peripheries of the first through hole and the second through hole is formed between the smoke collecting hood and the cover plate; a sealing gasket is mounted within the annular chamber; a third through hole aligned with the first through hole and the second through hole is formed in the center of the sealing gasket; the lifting rods successively pass through the second through hole, the third through hole and the first through hole; the outer walls of the lifting rods are fitted with or adjacent to the sealing gasket; and, the lifting rods can slide relative to the sealing gasket. With the above structure, the smoke can be effectively prevented from entering the mounting space above the smoke collecting hood through the through holes on the smoke collecting hood and the cover plate, so that the motor and the transmission mechanism are ensured to always be in a non-smoke environment, the lifting rods can move smoothly, and the service life of both the motor and the transmission mechanism is prolonged.

Further, preferably, the sealing gasket is limited between the smoke collecting hood and the cover plate in a lifting direction of the lifting rods, and a play space for allowing the sealing gasket to deflect in the lifting direction of the lifting rods is reserved between the periphery of the sealing gasket and the inner wall of the annular chamber. In this way, the smoke collecting hood and the cover plate can limit the movement of the lifting rods in a sliding direction, but the sealing gasket is allowed to deflect along with the lifting rods in a direction perpendicular to the sliding direction, so that the floated sealing effect is realized.

To prevent the lifting rods from directly contacting with the smoke collecting hood when the sealing gas deflects along with the lifting rods, the aperture of the first through hole is smaller than that of the second through hole, the aperture of the third through hole is smaller than that of the first through hole, a stop collar extending into the first through hole is formed on an edge of the third through hole by the sealing gasket, and a play space is reserved between the stop collar and the edge of the first through hole.

The sealing gasket can have various limiting mechanisms between the smoke collecting hood and the cover plate. One side surface of the sealing gasket is resisted against the smoke collecting hood, bumps disposed at intervals are formed on the other side surface of the sealing gasket, and the bumps are resisted against or close to the cover plate. In this way, by providing bumps arranged at intervals on the sealing gasket, the friction between the sealing gasket and the cover plate during the deflection process can be reduced.

The sealing gasket can be made of various materials. As a preferred solution, the sealing gasket is a plastic member or a rubber member, and a fit clearance is reserved between the edge of the third through hole of the sealing gasket and the lifting rods. Since the plastic member or the rubber plastic is relatively hard, after the fit clearance is reserved between the sealing gasket and the lifting rods, the contact friction between the lifting rods and the sealing gasket can be avoided, and the lifting rods are allowed to move more smoothly.

Further, preferably, the width of the fit clearance is 0.08 mm to 0.12 mm.

As another preferred solution, the sealing gasket is a felt member, and the edge of the third through hole of the sealing gasket directly come contact with the lifting rods. After the sealing gasket directly comes into contact with the lifting rods, the oil-proof effect is better. Moreover, since the felt member is relatively soft, during the movement of the lifting rods relative to the sealing gasket, the felt member can scrape off oil dirt attached to the lifting rods, so that the lifting rods are allowed to move more smoothly.

Compared with the prior art, the present invention has the following advantages. In the lifting mechanism for a moving component of a range hood, the transmission mechanism disposed on the mounting frame provides a driving power for the movement of upward and downward, and the driving power is then transferred to the two sides of the mounting frame by the connecting member. The guide rails located at the two sides of the mounting frame can ensure the stability of the lifting movement, and the lifting rods connected to the two side portions of the connecting member further transfers the lifting movement to the moving component, so that, the lifting movement of the moving component is very stable. In addition, in the range hood using the lifting mechanism, the mounting space for mounting the motor and the transmission mechanism is formed between the outer fan hood and the decorative hood, and the lifting rods pass downward through the smoke collecting hood to be connected to the moving component. The motor and the transmission mechanism are relatively reasonable in mounting site, and the motor and the transmission mechanism are ensured to be always in a non-smoke environment, so that the lifting rods can be moved smoothly, and the service life of the motor and the transmission mechanism is prolonged.

DETAILED DESCRIPTION OF THE PREFERRED EMBODIMENT

Figure 1:
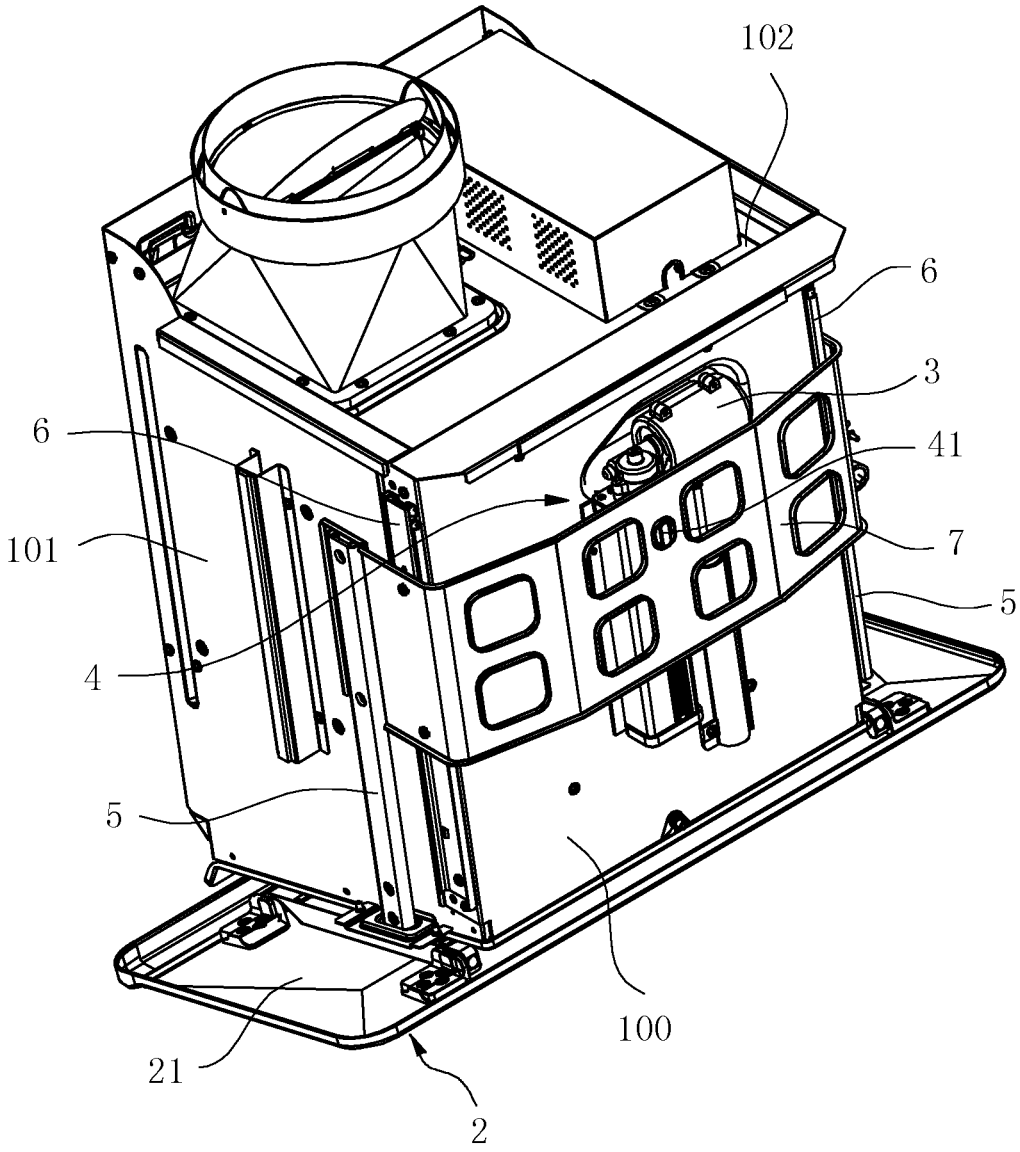
FIG. 1 is a perspective view of a range hood with a lifting mechanism according to Embodiment 1 of the present invention, showing the lifting mechanism when the smoke guide plate is in an ascending state.
Figure 2:
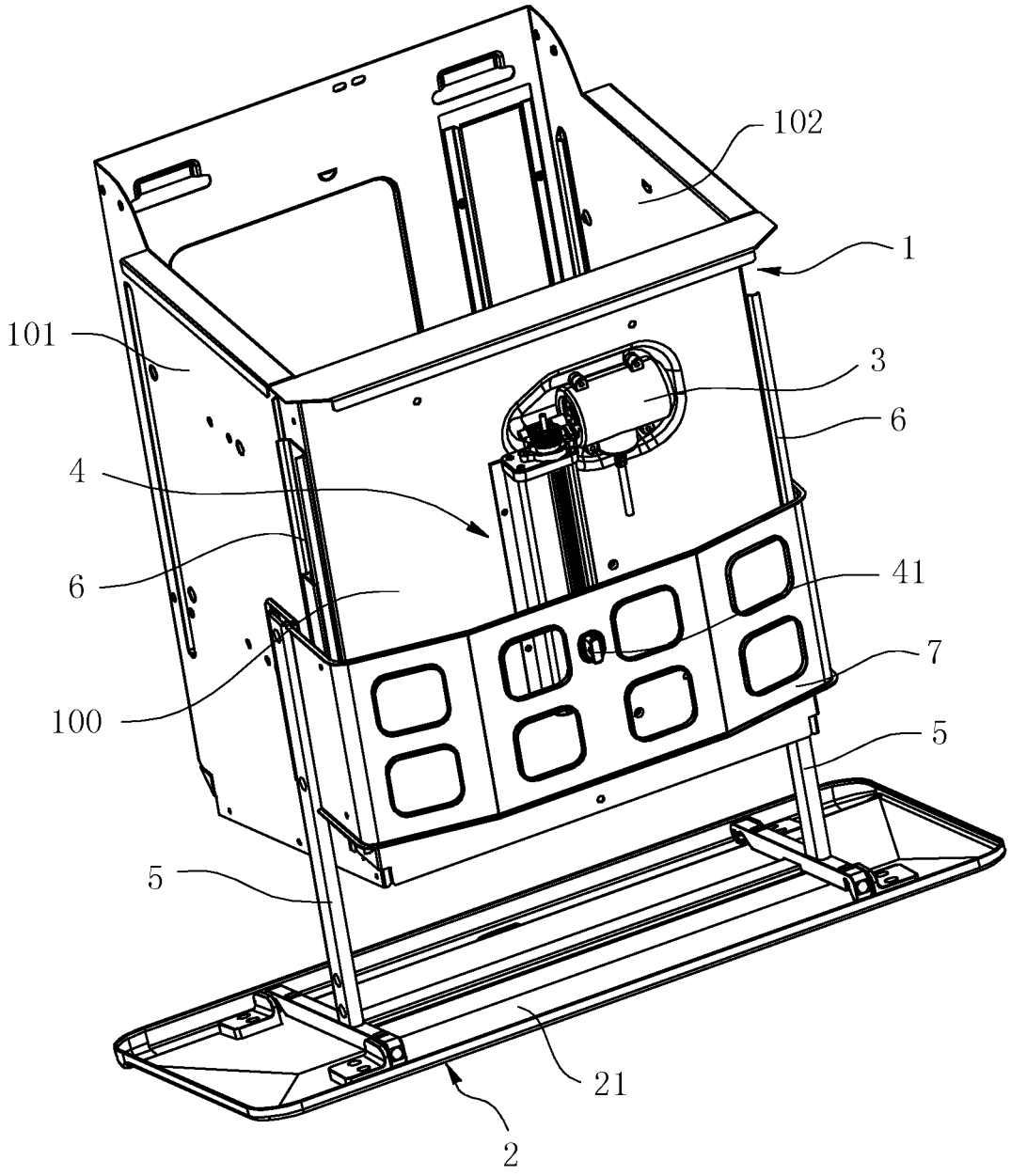
FIG. 2 is a perspective view of the range hood with the lifting mechanism according to Embodiment 1 of the present invention, showing the lifting mechanism when the smoke guide plate is in a descending state.
Figure 3:
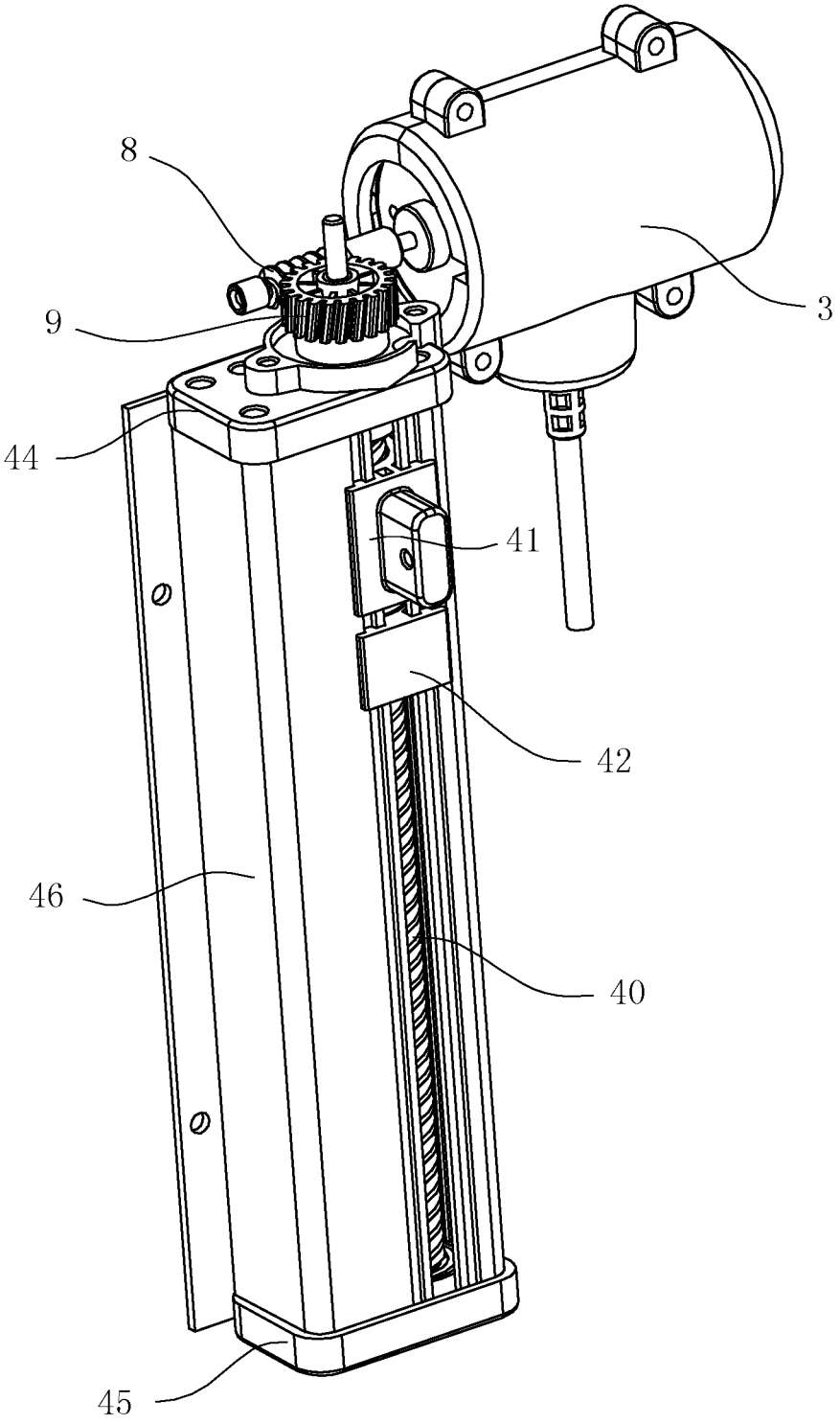
FIG. 3 is a perspective view of the transmission mechanism of the lifting mechanism according to Embodiment 1 of the present invention.
Figure 4:
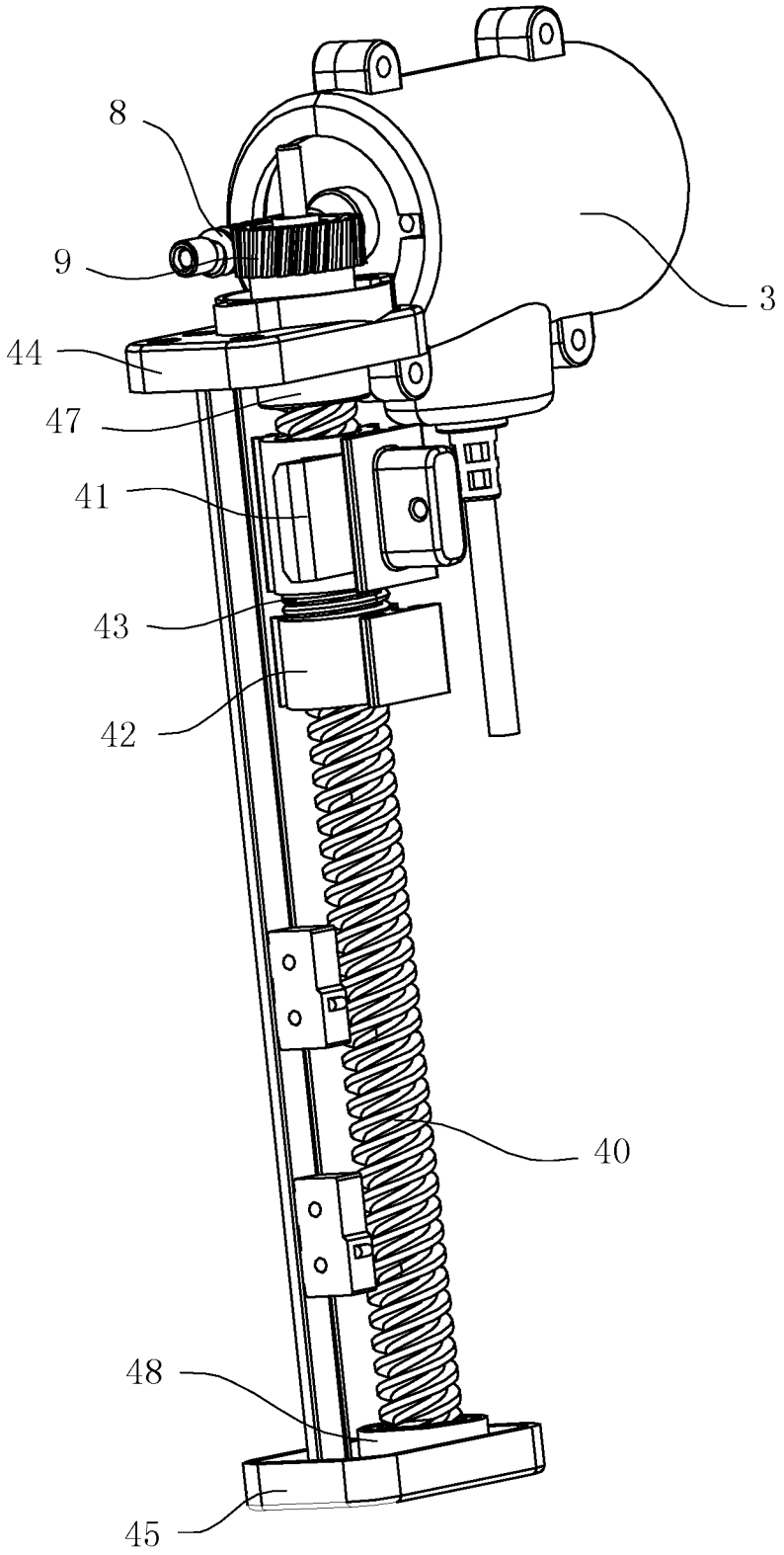
FIG. 4 is a perspective view of FIG. 3 after a lead screw shield is removed.
Figure 5:
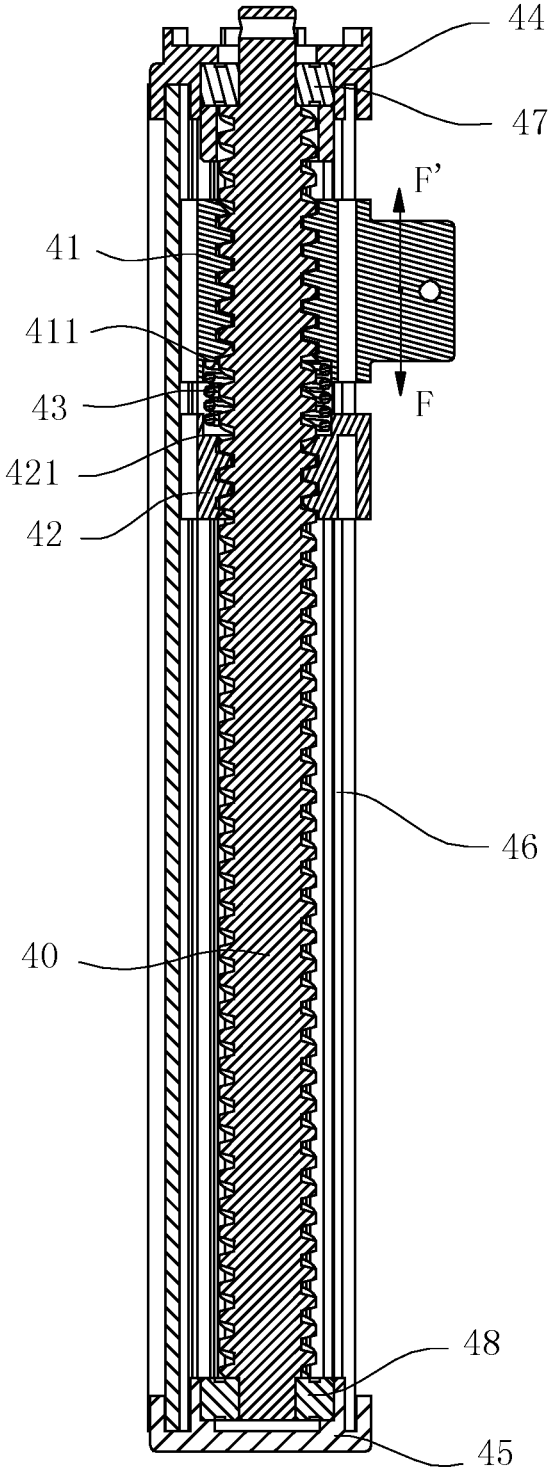
FIG. 5 is a sectional view of the transmission mechanism of FIG. 3.
Figure 6:
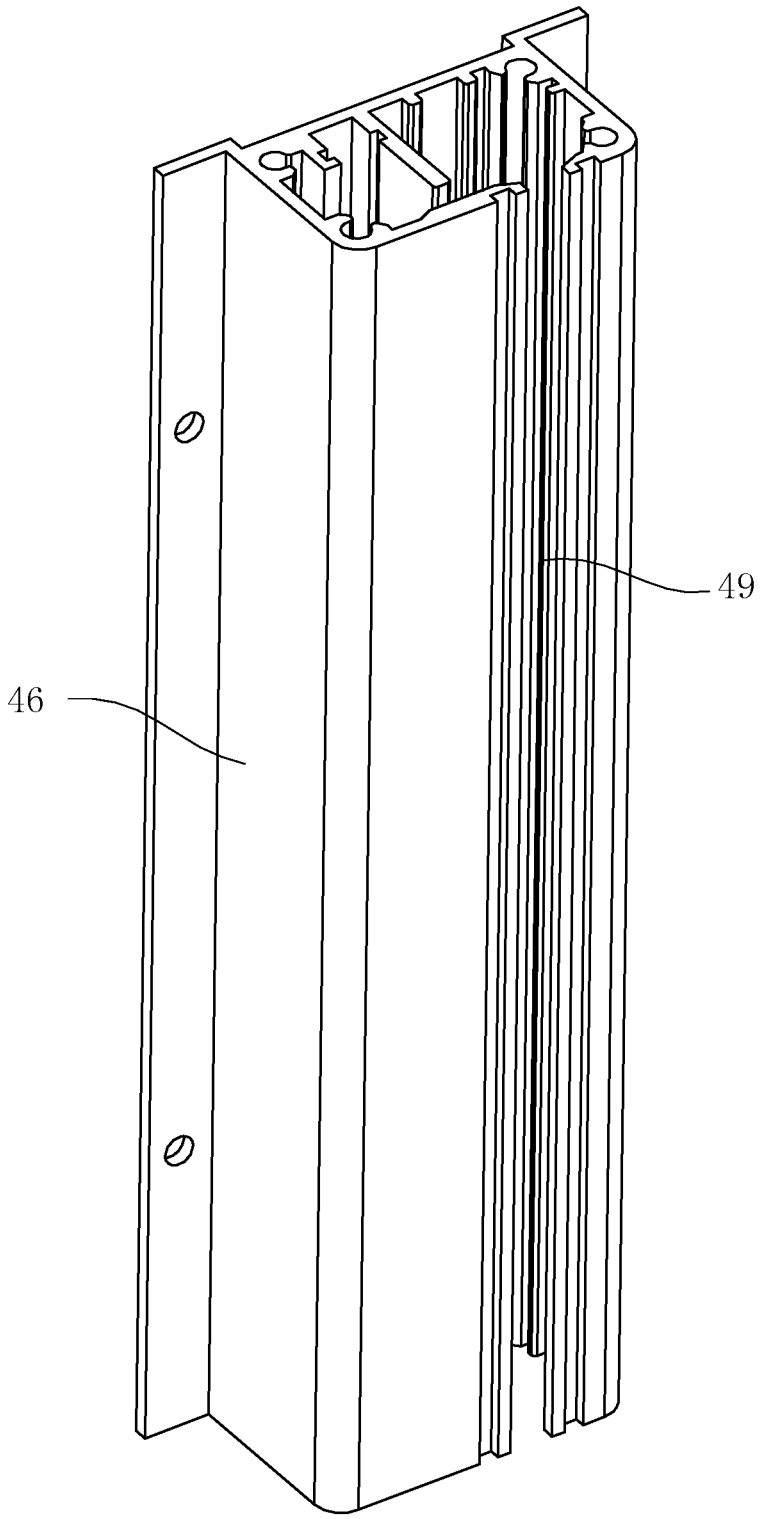
FIG. 6 is a perspective view of the lead screw shield of the transmission mechanism of FIG. 3.

To enable a further understanding of the present invention content of the invention herein, refer to the detailed description of the invention and the accompanying drawings below:

Embodiment 1

FIGS. 1-15 show a first embodiment of the lifting mechanism for a moving component of a range hood and the range hood with the lifting mechanism according to the present invention. As shown in FIGS. 1-6, the moving component of the range hood in this embodiment is a smoke guide plate 21. The lifting mechanism comprises a mounting frame 1, the smoke guide plate 21, a motor 3, a transmission mechanism 4 connected to the motor 3, two lifting rods 5, a connecting member, and two guide rails 6.

The mounting frame 1 has a front plate 100, a left side plate 101 and a right side plate 102. Both the motor 3 and the transmission mechanism 4 are mounted on the front plate 100, and the transmission mechanism 4 is located at the middle of the front plate 100 and driven by the motor 3. The two lifting rods 5 each having a bottom, are arranged vertically, and are respectively located at the left side and right side of mounting frame 1. The connecting member is a U-shaped connecting plate 7 with a front portion, a left portion, and a right portion, located outside the mounting frame 1. The bottom of each lifting rods 5 is attached to the smoke guide plate 21, and each of the left portion and the right portion of the connecting plate 7 is attached to the top of a corresponding lifting rod 5. Two guide rails 6 are vertically mounted on the left side plate 101 and the right side plate 102 of the mounting frame 1, respectively. Each of the left portion and the right portion of the connecting plate 7 can slide along the corresponding guide rail 6, and the front portion of the U-shaped connecting plate 7 is connected to an output end of the transmission mechanism 4. During the operation, the motor 3 drives the U-shaped connecting plate 7 to move up and down along the guide rails 6 through the transmission mechanism 4, so that the lifting rods 5 and the smoke guide plate 21 are allowed to move up and down together.

In this embodiment, the transmission mechanism 4 uses a lead-screw nut mechanism, specifically comprising a lead screw 40, a first nut 41, a second nut 42, a spring 43, an upper mounting seat 44, a lower mounting seat 45, a lead screw shield 46, a first bearing 47, a second bearing 48 and other components. The output shaft of the motor 43 drives the lead screw 40 to rotate through the transmission of a screw rod 8 and a transmission gear 9. Specifically, the lead screw 40 is arranged vertically, a screw rod 8 is arranged transversely and mounted on the output shaft of the motor 3, the transmission gear 9 is mounted at an end of the lead screw 40, coaxially to the lead screw 40, and the transmission gear 9 is engaged with the screw rod 8. In this way, the motor 3 can drive the lead screw 40 to rotate through the transmission of the screw rod 8 and the transmission gear 9.

The first nut 41 and the second nut 42 are successively disposed on the lead screw 40 from the top down. The spring 43 is sheathed on the lead screw 40 and placed between the first nut 41 and the second nut 42. A recessed first mounting step 411 is disposed on a bottom surface of the first nut 41, a recessed second mounting step 421 is disposed on a top surface of the second nut 42, and two ends of the spring 43 are resisted against the first mounting step 411 and the second mounting step 421, respectively.

The first nut 41 forms the output terminal of the transmission mechanism 4, and the U-shaped connecting plate 7 is disposed on the first nut 41. The U-shaped connecting plate 7, the lifting rods 5 and the smoke guide plate 21 form a load. The gravity of the load, the gravity of the first nut 41 and a component force of the friction between the first nut and the lead screw in a vertical downward direction form a resultant force F, and the spring 43 applies a vertical upward elastic force F' to the first nut 41.

Two situations where the first nut 41 is moved up and down will be analyzed below.

(1) The first nut 41 is driven to move down at a constant speed by the rotation of the screw rod 40.

When $0 \leq F' < F$ and when the first nut 41 is exactly moved to a position with a clearance, the direction of the resultant force of F' and F is downward and is the same as the direction of motion of the first nut 41. At this time, the first nut 41 will be weightless temporarily, and the downward acceleration will increase the movement speed of the first nut 41. Then, the first nut 41 impacts a lower interface of the clearance so as to generate impact noise. This situation will generally occur periodically with the rotation of the screw rod 40.

When $F' \geq F$, the direction of the resultant force of F' and F is upward and is opposite to the direction of motion of the first nut 41. At this time, the first nut 41 will not be weightless, and the mechanism will not generate any noise and jitter during its movement.

(2) The first nut 41 is driven to move up at a constant speed by the rotation of the screw rod 40.

When $0 \leq F' \leq F$, the direction of the resultant force of F' and F is downward and is opposite to the direction of motion of the first nut 41. At this time, the first nut 41 will not be weightless, and the mechanism will not generate any noise and jitter during its movement.

When $F' > F$ and when the first nut 41 is exactly moved to a position with a clearance, the direction of the resultant force of F' and F is upward and is the same as the direction of motion of the first nut 41. At this time, the first nut 41 will be weightless temporarily, and the mechanism will generate noise and jitter during its movement.

It can be known from the two motion processes of the first nut 41 that, when the condition of $F'=F$ is satisfied, the first nut 41 can be prevented from colliding with the lead screw 40 during its upward or downward movement due to the fit clearance between the first nut and the screw rod 40, and the lead-screw nut mechanism is further prevented from generating noise and jitter during the operation process.

The lead screw shield 46 is used for protecting the lead screw 40. The upper mounting seat 44 and the lower mounting seat 45 are disposed at two ends of the lead screw shield 46, respectively. The first bearing 47 is disposed on the upper mounting seat 44, and an upper end of the lead screw 40 is mounted on the first bearing 47. The second bearing 48 is disposed on the lower mounting seat 45, and a lower end of the lead screw 40 is mounted on the second bearing 48. Strip-shaped holes 49 disposed vertically are formed on the lead screw shield 46, and the first nut 41 and the second nut 42 partially pass through the strip-shaped holes 49 and are exposed out of the lead screw shield 46. In addition, to enable the first nut 41, the second nut 42 and the load disposed on the first nut 41 to move stably, guide fitting mechanisms are provided between the first nut 41 and the lead screw shield 46 and between the second nut 42 and the lead screw shield 46. The guide fitting mechanisms can be convention fitting mechanisms of ribs and grooves, and will not be repeated herein.

Figure 7:
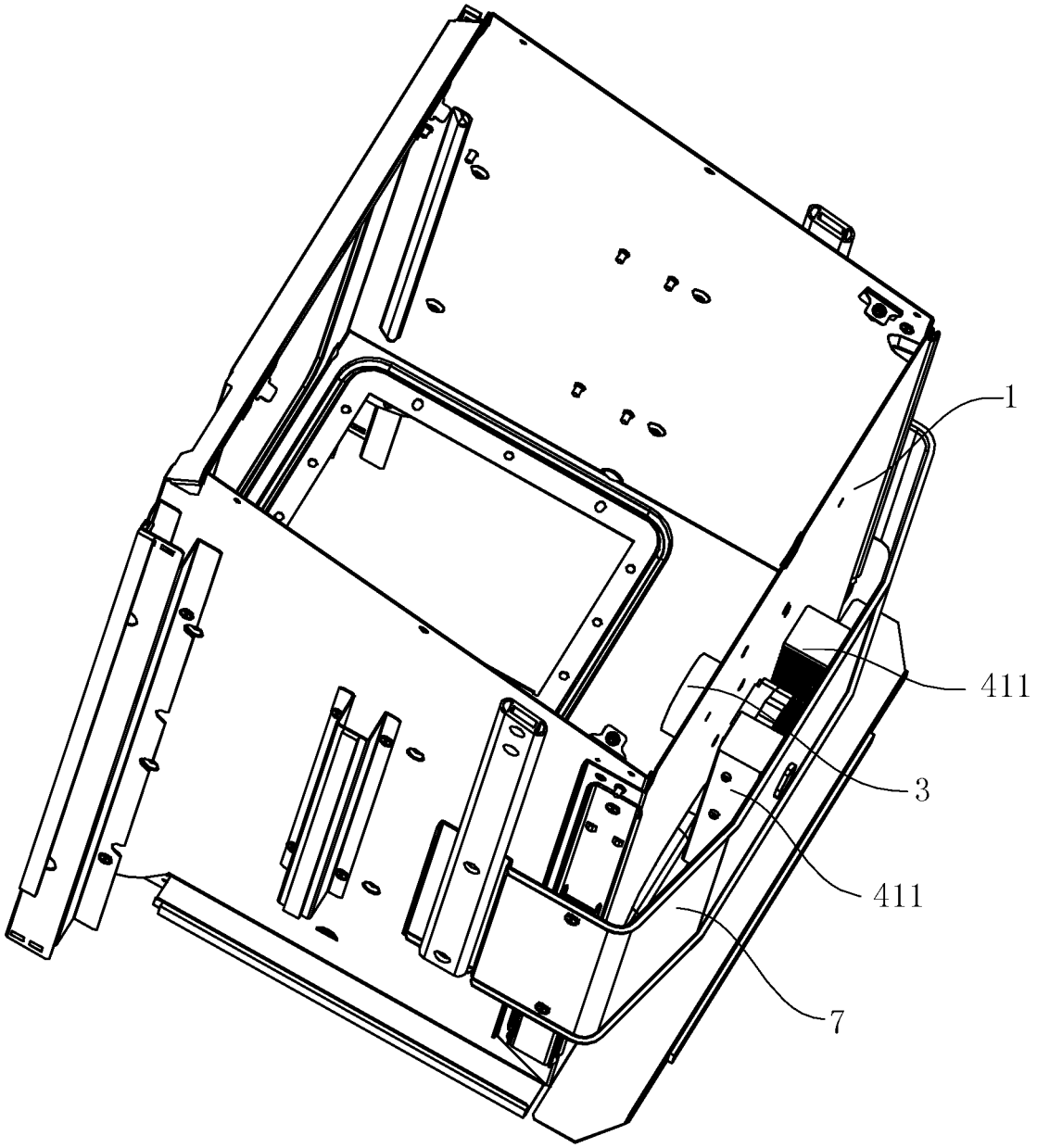
FIG. 7 is a perspective view of another kind of the transmission mechanism of the lifting mechanism according to Embodiment 1 of the present invention.
Figure 8:
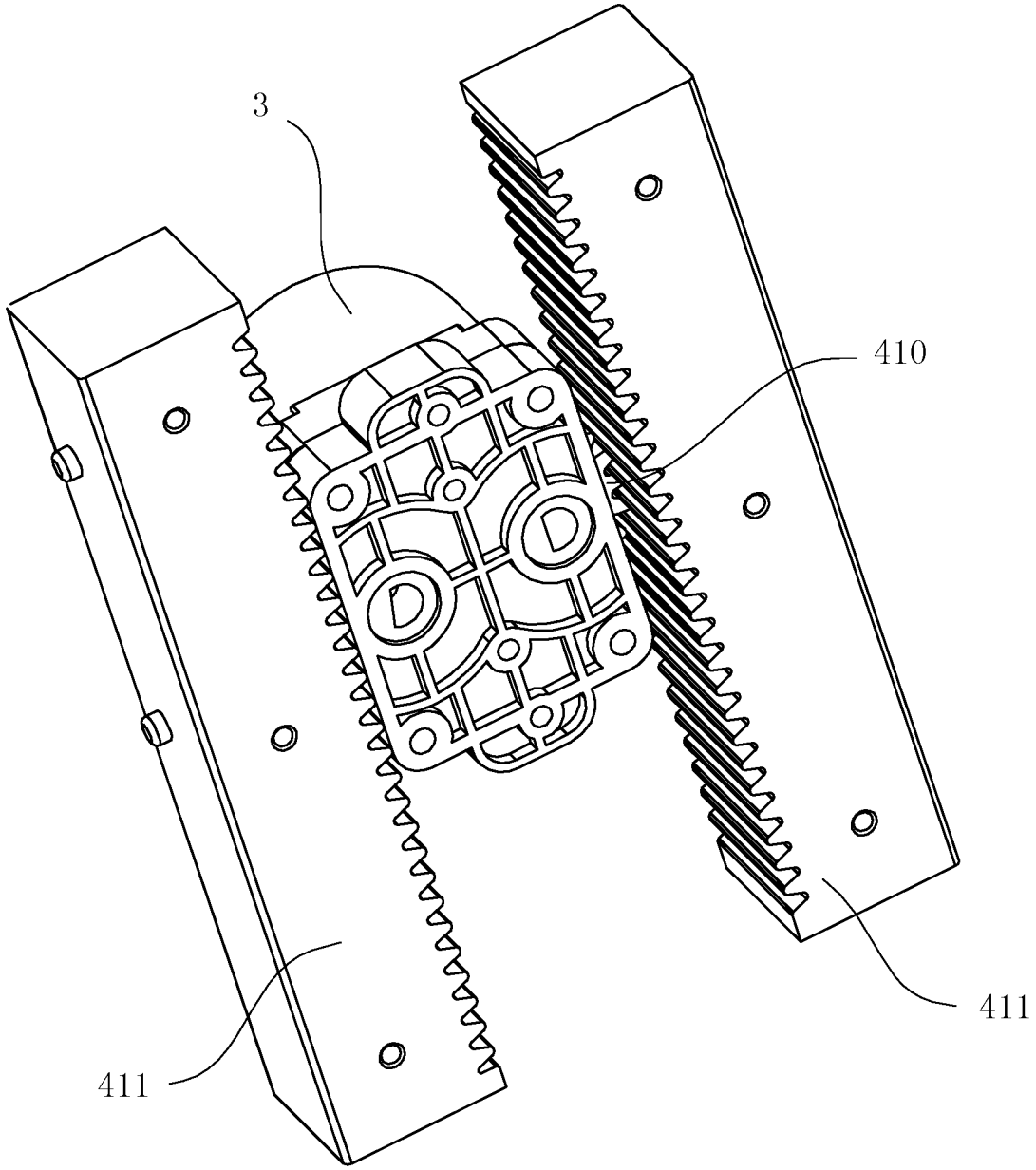
FIG. 8 is a partial perspective view of the transmission mechanism of FIG. 7.

FIGS. 7 and 8 show another kind of the transmission mechanism 4, this kind of transmission mechanism 4 comprises a gear 410 and a rack e411. The motor 3 drives the gear 410 to rotate, the rack 411 is engaged with the gear 410 and does a lifting motion under the drive of the gear 410, and the U-shaped connecting plate 7 is disposed on the rack 411. During the operation, the rack 411 is driven to move up and down by the motor 3, so that the lifting rods 5 and the smoke guide plate 21 are driven to move upward and downward together by the U-shaped connecting plate 7.

Figure 9:
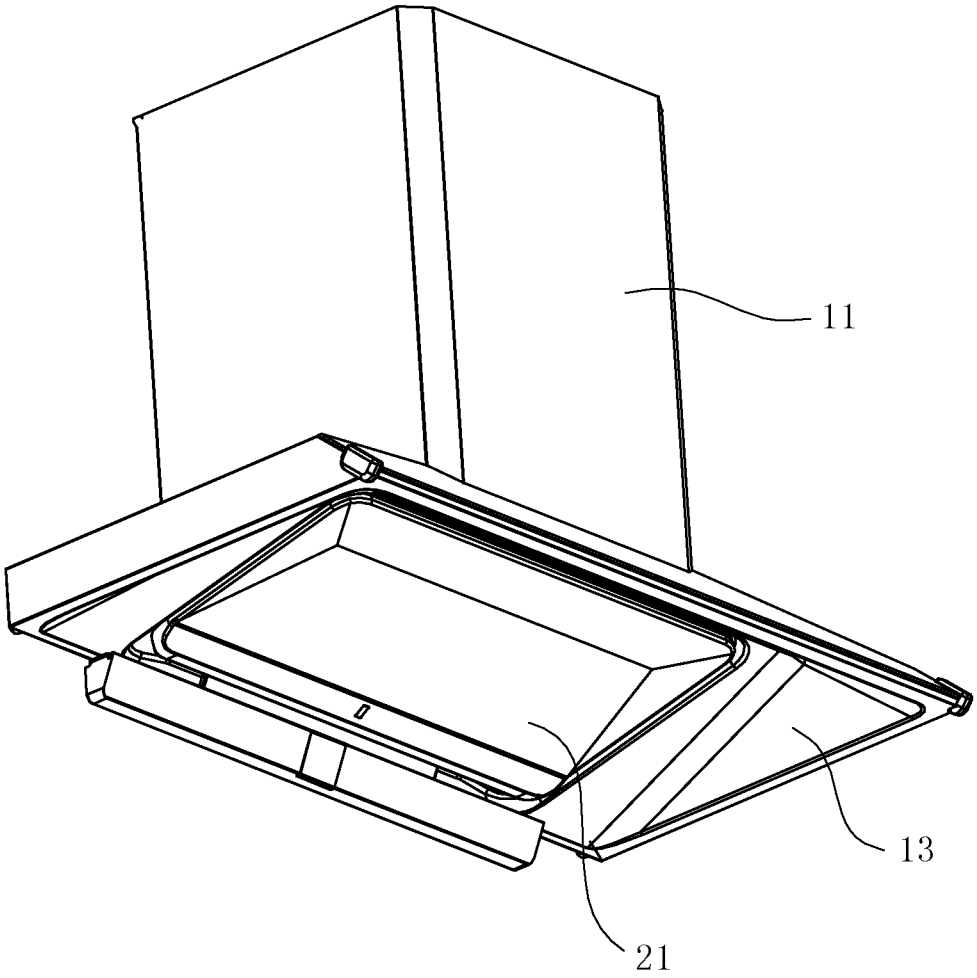
FIG. 9 is a perspective view of the range hood with the lifting mechanism according to Embodiment 1 of the present invention.
Figure 10:
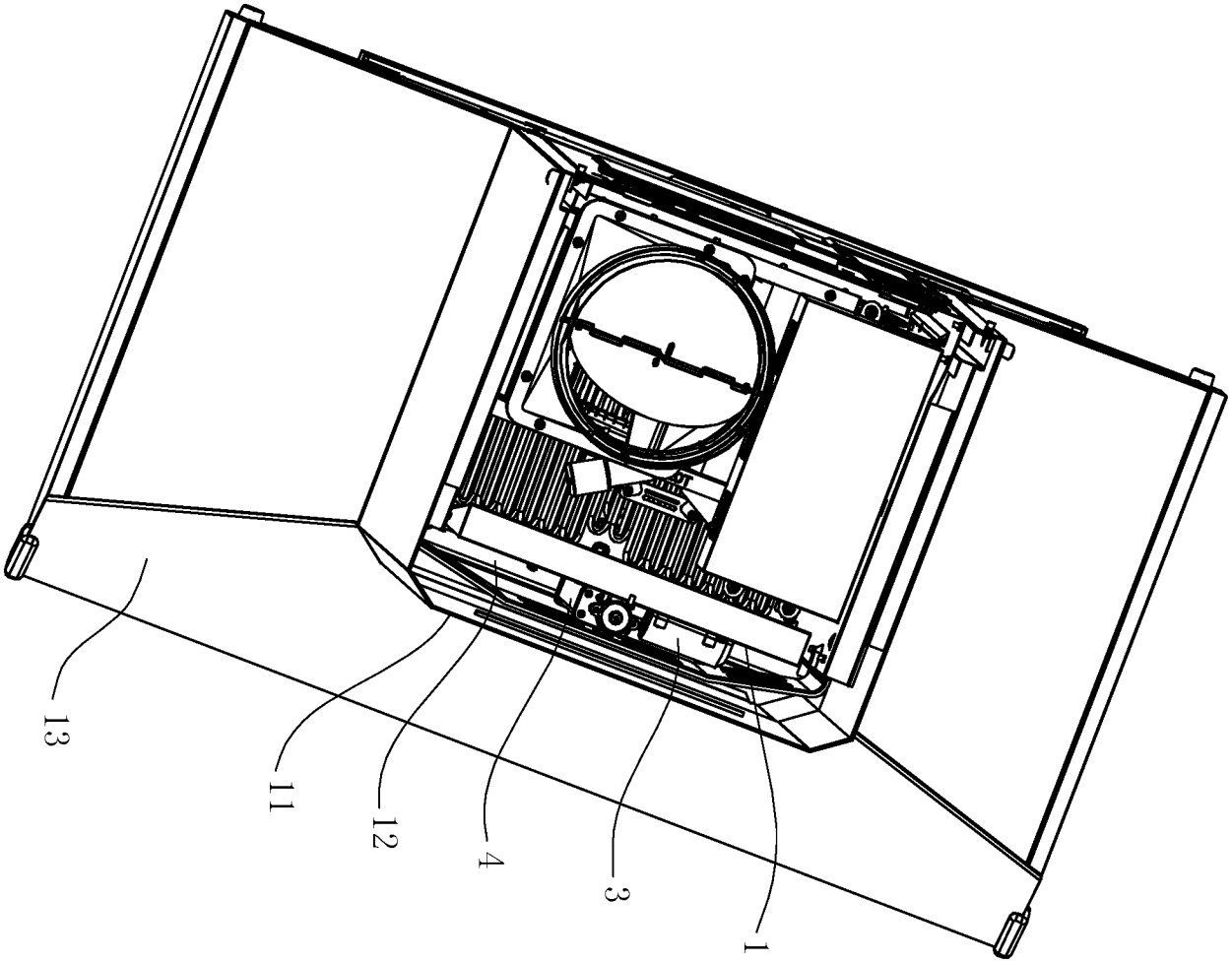
FIG. 10 is another perspective view of the range hood of FIG. 9.
Figure 11:
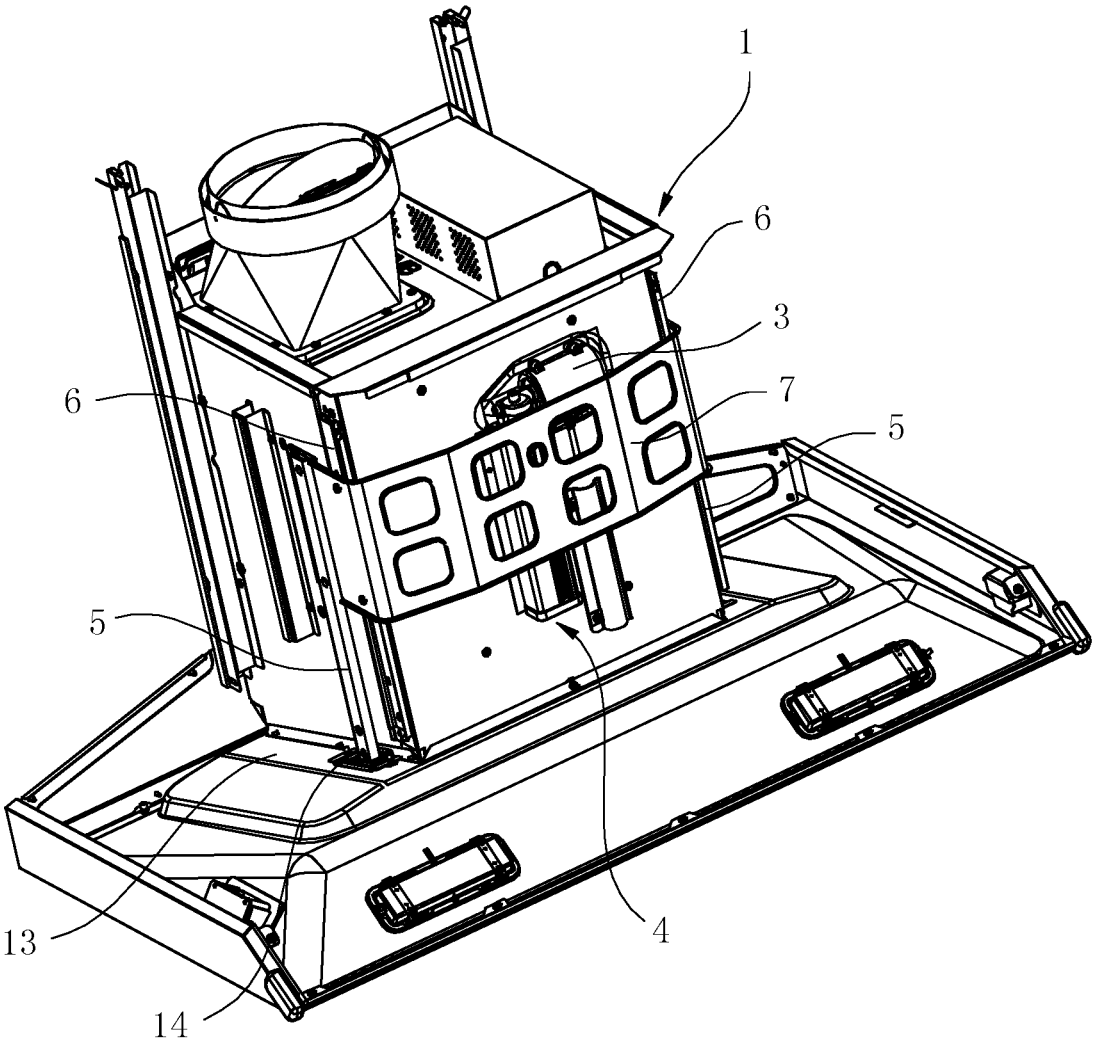
FIG. 11 is a perspective view of the range hood of FIG. 9 after a decorative hood is removed.
Figure 12:
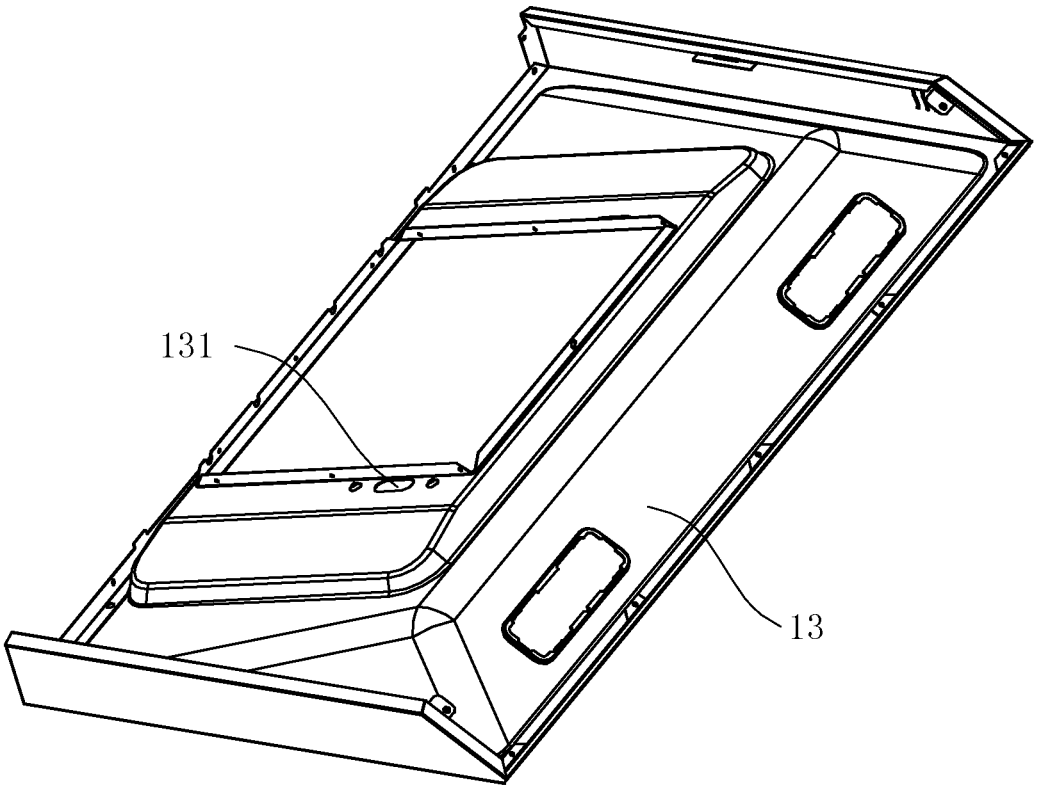
FIG. 12 is a perspective view of the smoke collecting hood according to Embodiment 1 of the present invention.
Figure 13:
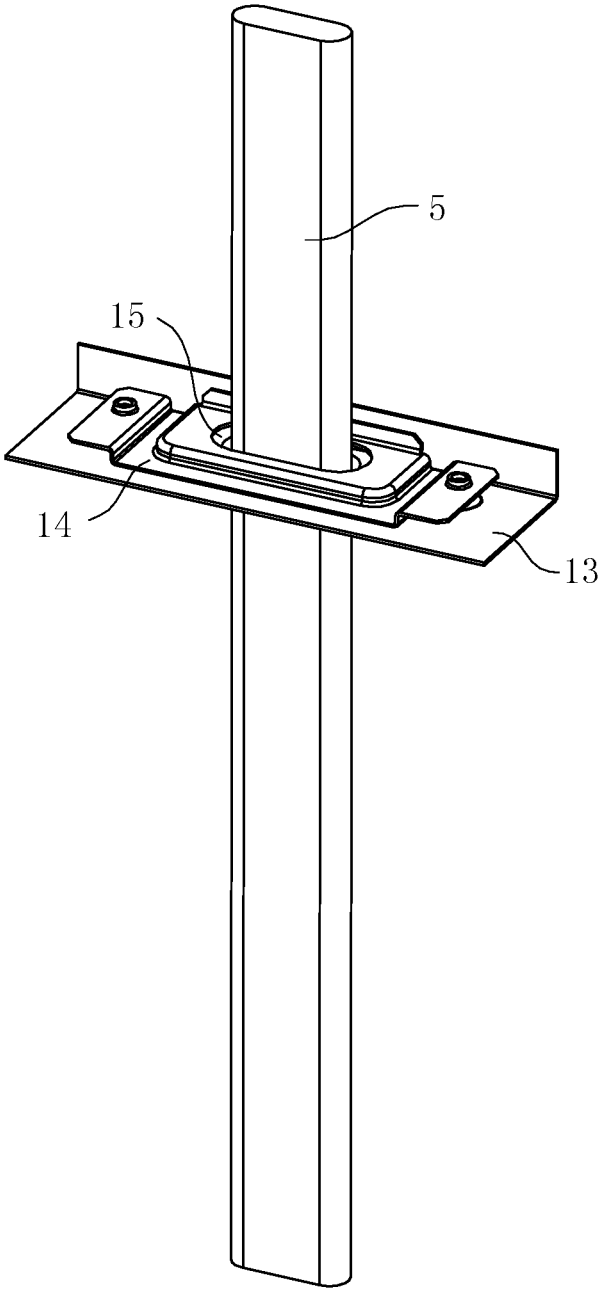
FIG. 13 is a perspective view of the lifting rod and the cover plate according to Embodiment 1 of the present invention, showing the mounting structure of lifting rods.
Figure 14:
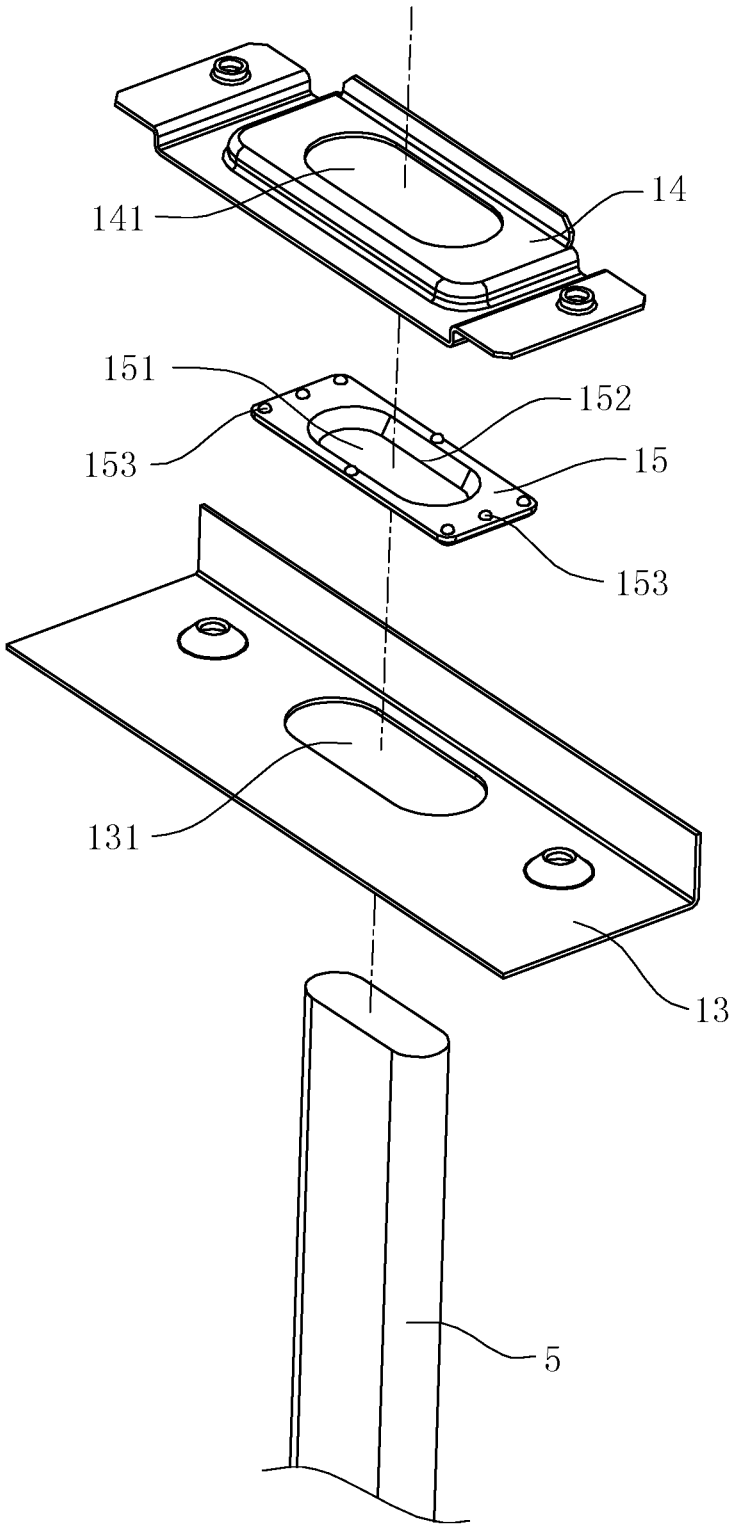
FIG. 14 is a exploded view of FIG. 13.
Figure 15:
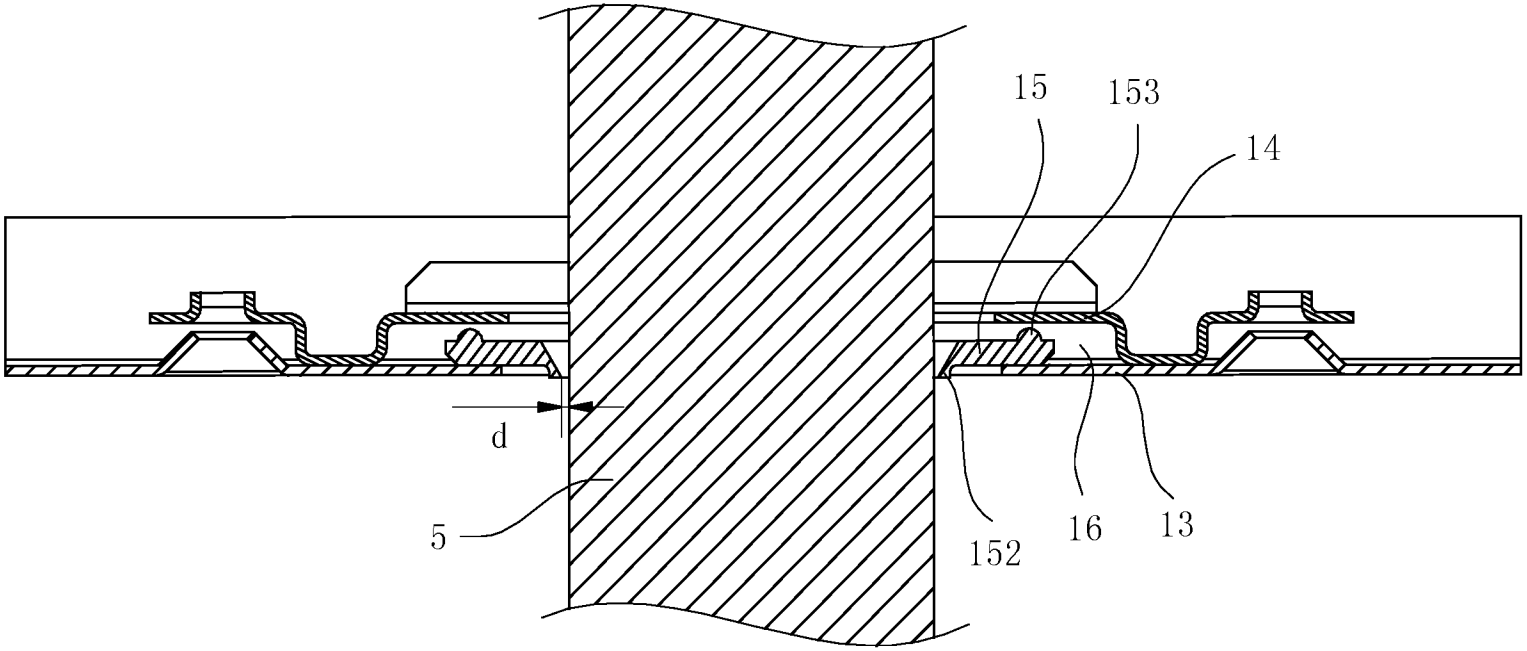
FIG. 15 is a sectional view of FIG. 14.

As shown in FIGS. 9-11, the range hood of the first embodiment uses the above said lifting mechanism. The range hood comprises an outer fan hood, a decorative hood 11, a smoke collecting hood 13 and a smoke guide plate 21. The smoke guide plate 21 is located below the smoke collecting hood 13. The mounting frame 1 of the lifting mechanism is the outer fan hood. A mounting space 12 isolated from smoke is formed between the outer fan hood and the decorative hood 11, and both the motor 3 and the transmission mechanism 4 are mounted on the front plate 100 of the outer fan hood and inside the mounting space 12. The lifting rods 5 pass downward through the smoke collecting hood 13 and are connected to the smoke guide plate 21.

As shown in FIGS. 12-15, a first through hole 131 is formed on the smoke collecting hood 13, a cover plate 14 is covered at a position on the smoke collecting hood 13 corresponding to the first through hole 131, and a second through hole 141 aligned with the first through hole 131 is formed in the center of the cover plate 14, so that an annular chamber 16 surrounding the peripheries of the first through hole 131 and the second through hole 141 is formed between the smoke collecting hood 13 and the cover plate 14. A sealing gasket 15 is disposed within the annular chamber 16. A third through hole 151 aligned with the first through hole 131 and the second through hole 131 is formed in the center of the sealing gasket 15. The lifting rods 5 successively pass through the second through hole 141, the third through hole 151 and the first through hole 131. The outer walls of the lifting rods 5 are fitted with or adjacent to the sealing gasket 15, and the lifting rods 5 and the sealing gasket 15 can slide relative to the sealing gasket 15. After the sealing gasket 15 is mounted, two side surfaces of the sealing gasket 15 are limited between the smoke collecting hood 13 and the cover plate 14. A play space for allowing the sealing gasket 15 to deflect back and forth in a horizontal direction is reserved between the periphery of the sealing gasket 15 and the inner wall of the annular chamber 16.

In addition, the aperture of the first through hole 131 is smaller than that of the second through hole 141, the aperture of the third through hole 151 is smaller than that of the first through hole 131, a stop collar 152 extending into the first through hole 131 is formed on an edge of the third through hole 151 by the sealing gasket 15, and a play space is reserved between the stop collar 152 and the edge of the first through hole 131. In this way, when the sealing gasket 15 is deflected in the horizontal direction along with the lifting rods 5, the lifting rods 5 can be prevented from directly contacting with the smoke collecting hood 13, and the lifting rods 5 will not be damaged during its movement.

In this embodiment, a lower side surface of the sealing gasket 15 is resisted against the smoke collecting hood 13, bumps 153 arranged at intervals are formed on an upper side surface of the sealing gasket 15, and the bumps 153 are arranged on the periphery of the sealing gasket 15. The bumps 153 are preferably convex points. The bumps 15 can be resisted against the cover plate 14 directly. The bumps 15 can also be close to the cover plate 14 so that a small clearance is reserved between the bumps and the cover plate.

In this embodiment, the sealing gasket 15 can be made of many different materials. For example, the sealing gasket may be made of a relatively hard material, for example, a plastic member or a rubber member. When the sealing gasket is a plastic member or a rubber member, a fit clearance needs to be reserved between the edge of the third through hole 151 of the sealing gasket 15 and the lifting rods 5. The width of the fit clearance d is generally set as 0.08 mm to 0.12 mm, preferably d=0.1 mm, in order to prevent the contact friction between the lifting rods 5 and the sealing gasket 15 and enable the lifting rods 5 to move more smoothly. The sealing gasket can also be made of a relatively soft material such as felt. When the sealing gasket is a felt member, the edge of the third through hole 151 of the sealing gasket 15 directly comes into contact with the lifting rods 5, so that the oil-proof effect is better. Moreover, since the felt member is relatively soft, during the upward or downward movement of the lifting rods 5, the felt member can scrape off oil dirt on the lifting rods 5, so that the lifting rods 5 are allowed to move more smoothly.

During the operation, the transmission mechanism 4 drives the lifting rods 5 to move up and down, so as to drive the smoke guide plate 21 to move up and down. Due to the precision of the driving mechanism, the lifting rods 5 will be deflected to a certain extent in the horizontal direction during the upward and downward direction. By using the oil-proof sealing mechanism in this embodiment, the movement of the sealing gasket 15 in the vertical direction can be limited, and the degree of freedom in the horizontal direction is released, so that the whole sealing gasket 15 can be horizontally deflected along with the deflection of the lifting rods 5, and the floated sealing effect is achieved. Moreover, the smoke is prevented from entering the mounting space 12 through the through holes on the smoke collecting hood 13 and the cover plate 14, so that the motor 3 and the transmission mechanism 4 are ensured to be always in a non-smoke environment, and the lifting rods 5 can be moved up and down smoothly.

Embodiment 2

Figure 16:
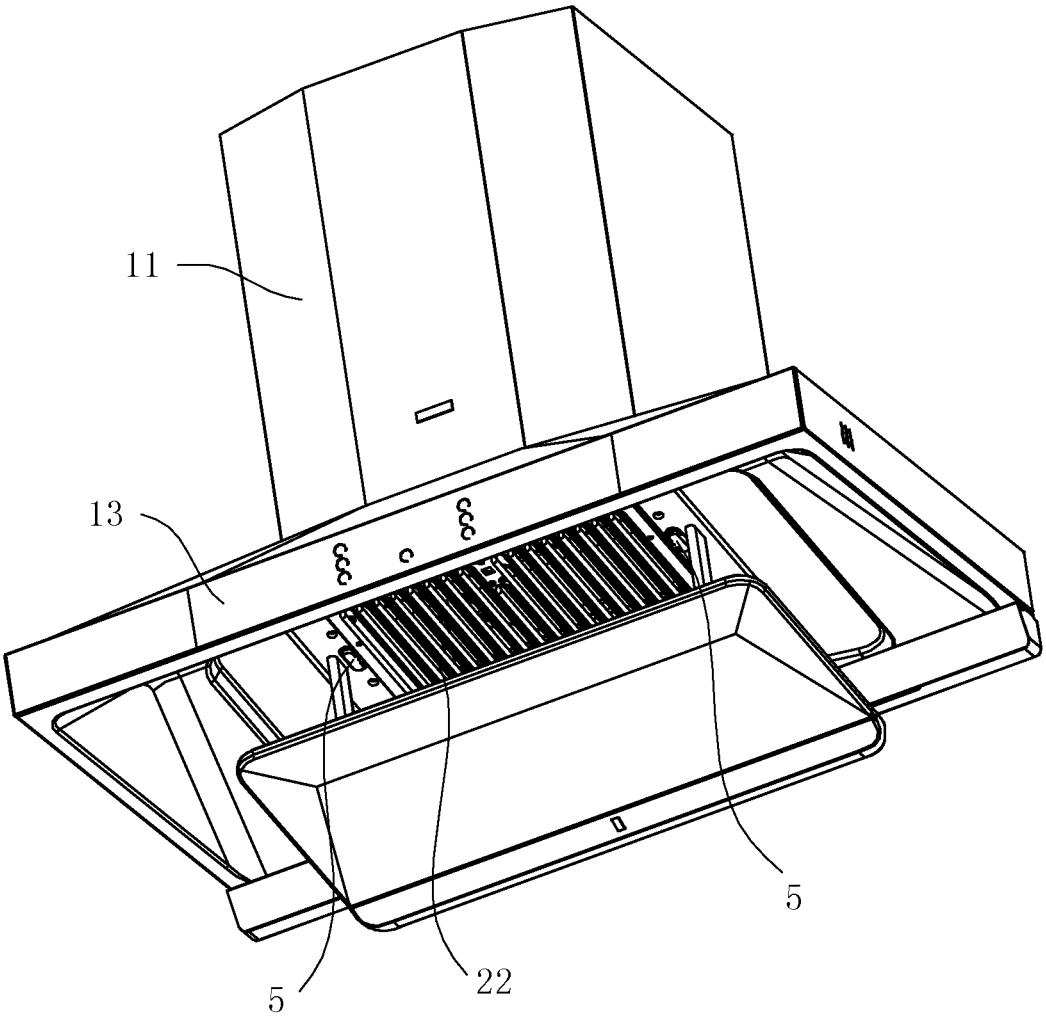
FIG. 16 is a perspective view of a range hood according to Embodiment 2 of the present invention.
Figure 17:
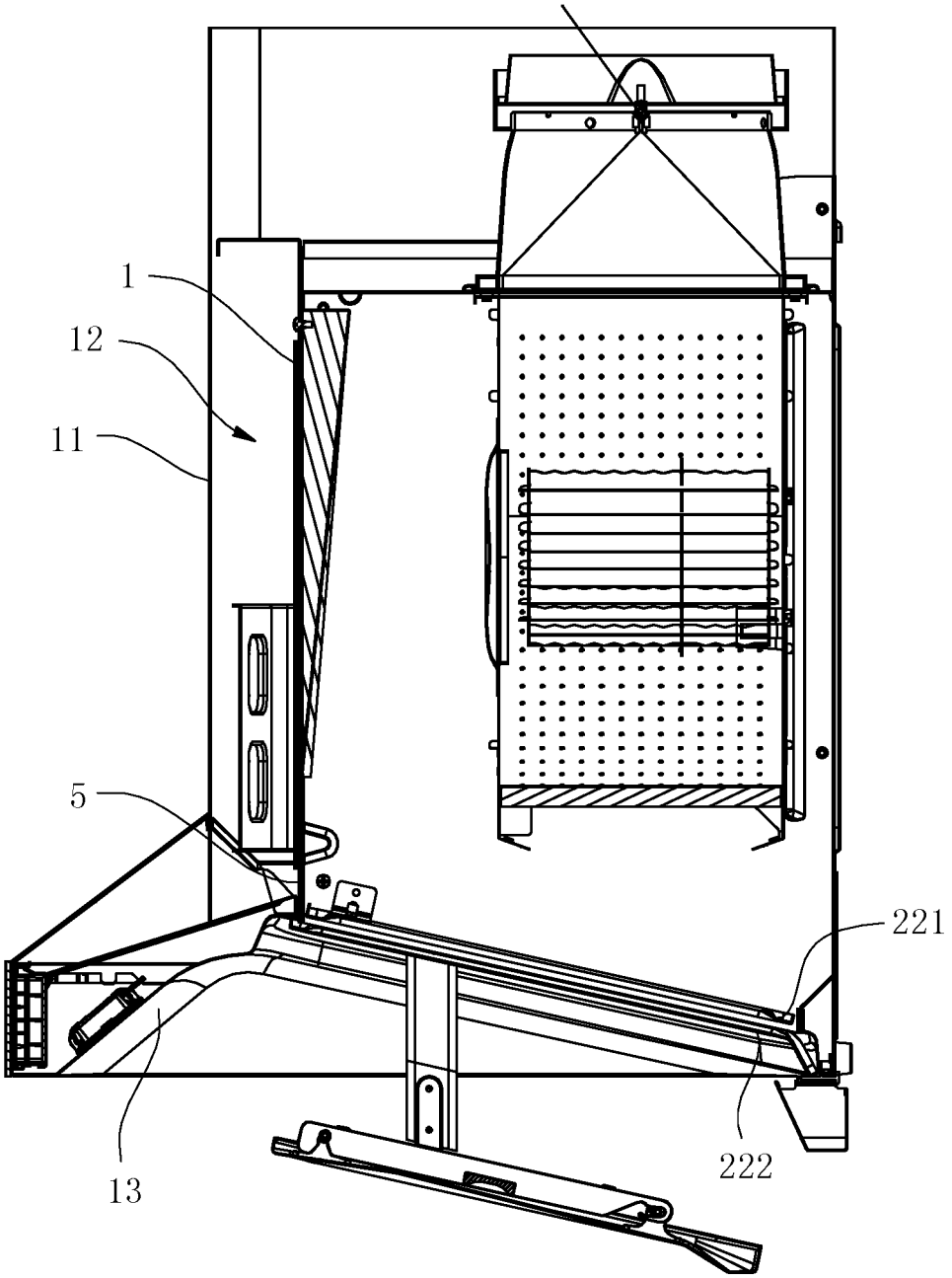
FIG. 17 is a sectional view of the range hood according to Embodiment 2 of the present invention.

As shown in FIGS. 16 and 17, in this embodiment, the moving component of the range hood is an oil filter screen 22. The oil filter screen 22 is of a double-layer structure consisting of an inner oil filter screen 221 and an outer oil filter screen 222. The inner oil filter screen 221 is a fixed oil screen and is fixed on the smoke collecting hood 13. The lifting rods 5 of the lifting mechanism extend downward out from the mounting space 12 and are connected to the outer oil filter screen 222. The outer oil filter screen 222 is a moving oil screen and moves up and down relative to the inner oil filter screen 221 under the drive of the lifting mechanism, so that the distance between the inner oil filter screen 221 and the outer filter screen 222 is changed. As a result, the change in air volume of the range hood is adjusted, and the range hood is always in the optimal operating state.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. A lifting mechanism for a moving component of a range, comprising:

a mounting frame;

a moving component located below the mounting frame;

a motor;

a transmission mechanism connected to the motor;

at least two lifting rods located at the sides of mounting frame, each lifting rod having a bottom;

a connecting member connecting the at least two lifting rods to the transmission mechanism; and at least two guide rails located at the sides of mounting frame;

wherein the transmission mechanism comprises a lead screw, a first nut, a second nut, and a spring, the lead screw is disposed vertically and driven to rotate by the motor, the first nut and the second nut are successively disposed on the lead screw from the top down, the spring is sheathed on the lead screw and placed between the first nut and the second nut, the first nut is attached to the connecting member;

the spring applies a vertical upward elastic force to the first nut, so that the first nut is prevented from colliding with the lead screw during its movement due to a fit clearance between the first nut and the lead screw;

the transmission mechanism is attached to the mounting frame;

the bottom of each lifting rod is connected to the moving component; and, the transmission mechanism moves the connecting member up and down along the guide rails, so that the lifting rods and the moving component are allowed to move up and down.

2. The lifting mechanism of claim 1, wherein the mounting frame has a front plate, a left side plate and a right side plate;

the motor and the transmission mechanism are disposed on the front plate;

the guide rails are disposed on the left side plate and the right side plate;

the connecting member is a U-shaped connecting plate with a front portion, a left portion, and a right portion located outside the mounting frame;

the left portion and the right portion of the connecting plate, each is attached to the top of a corresponding lifting rod;

the left portion and the right portion of the connecting plate each can slide along the corresponding guide rail;

and the front portion of the U-shaped connecting plate is connected to an output end of the transmission mechanism.

3. The lifting mechanism of claim 1, wherein a recessed first mounting step is disposed on a bottom surface of the first nut;

a recessed second mounting step is disposed on a top surface of the second nut; and, two ends of the spring are resisted against the first mounting step and the second mounting step, respectively.

4. The lifting mechanism of claim 1, wherein a screw rod is mounted on the output shaft of the motor, a transmission gear, which is disposed coaxially to the lead screw and can be rotated together, is mounted at an end of the lead screw, and the transmission gear is engaged with the screw rod.

5. The lifting mechanism of claim 4, wherein the transmission mechanism further comprises an upper mounting seat, a lower mounting seat and a lead screw shield disposed between the upper mounting seat and the lower mounting seat;

a first bearing is disposed on the upper mounting seat, and an upper end of the lead screw is mounted on the first bearing;

a second bearing is disposed on the lower mounting seat, and a lower end of the lead screw is mounted on the second bearing;

strip-shaped holes disposed vertically are formed on the lead screw shield; and, both the first nut and the second nut partially pass through the strip-shaped holes and are exposed out of the lead screw shield.

6. The lifting mechanism of claim 5, wherein the first nut and the second nut are respectively guided by the lead screw shield.

7. The lifting mechanism of claim 1, wherein the moving component is a smoke guide plate or an oil filter screen.

8. A range hood with the lifting mechanism of claim 1, comprising an outer fan hood, a decorative hood and a smoke collecting hood;

wherein the moving component of the lifting mechanism is disposed below the smoke collecting hood, the mounting frame of the lifting mechanism is the outer fan hood;

a mounting space is formed between the outer fan hood and the decorative hood;

the motor and the transmission mechanism are mounted on a front plate of the mounting frame and located inside the mounting space; and, the lifting rods pass downward through the smoke collecting hood and are connected to the moving component.

9. The range hood of claim 8, wherein a first through hole is formed on the smoke collecting hood;

a cover plate is covered at a position on the smoke collecting hood corresponding to the first through hole;

a second through hole aligned with the first through hole is formed in the center of the cover plate, so that an annular chamber surrounding the peripheries of the first through hole and the second through hole is formed between the smoke collecting hood and the cover plate;

a sealing gasket is disposed within the annular chamber;

a third through hole aligned with the first through hole and the second through hole is formed in the center of the sealing gasket;

the lifting rods successively pass through the second through hole, the third through hole and the first through hole;

the outer walls of the lifting rods are fitted with or adjacent to the sealing gasket; and, the lifting rods can slide relative to the sealing gasket.

10. The range hood of claim 9, wherein the sealing gasket is limited between the smoke collecting hood and the cover plate in a lifting direction of the lifting rods, and a play space for allowing the sealing gasket to deflect in the lifting direction of the lifting rods is reserved between the periphery of the sealing gasket and the inner wall of the annular chamber.

11. The range hood of claim 10, wherein the aperture of the first through hole is smaller than that of the second through hole, the aperture of the third through hole is smaller than that of the first through hole, a stop collar extending into the first through hole is formed on an edge of the third through hole by the sealing gasket, and a play space is reserved between the stop collar and the edge of the first through hole.

12. The range hood of claim 10, wherein one side surface of the sealing gasket is resisted against the smoke collecting hood, bumps disposed at intervals are formed on the other side surface of the sealing gasket, and the bumps are resisted against or close to the cover plate.

13. The range hood of claim 9, wherein the sealing gasket is a plastic member or a rubber member, and a fit clearance is reserved between the edge of the third through hole of the sealing gasket and the lifting rods.

14. The range hood of claim 13, wherein the width of the fit clearance is 0.08 mm to 0.12 mm.

15. The range hood of claim 9, wherein the sealing gasket is a felt member, and the edge of the third through hole of the sealing gasket directly come contact with the lifting rods.

* * * * *